US009982554B2

(12) United States Patent
Perrot et al.

(10) Patent No.: US 9,982,554 B2
(45) Date of Patent: May 29, 2018

(54) TURBINE ENGINE CASING AND ROTOR WHEEL

(71) Applicant: SNECMA, Paris (FR)

(72) Inventors: Vincent Paul Gabriel Perrot, Moissy-Cramayel (FR); Sébastien Cochon, Moissy-Cramayel (FR)

(73) Assignee: Snecma, Paris (FR)

( * ) Notice: Subject to any disclaimer, the term of this patent is extended or adjusted under 35 U.S.C. 154(b) by 357 days.

(21) Appl. No.: 14/430,864

(22) PCT Filed: Sep. 19, 2013

(86) PCT No.: PCT/FR2013/052172
§ 371 (c)(1),
(2) Date: Mar. 24, 2015

(87) PCT Pub. No.: WO2014/049239
PCT Pub. Date: Apr. 3, 2014

(65) Prior Publication Data

US 2015/0226078 A1 Aug. 13, 2015

(30) Foreign Application Priority Data

Sep. 25, 2012 (FR) ..... 12 58959

(51) Int. Cl.
*F01D 11/12* (2006.01)
*F01D 25/24* (2006.01)
(Continued)

(52) U.S. Cl.
CPC ..... *F01D 11/122* (2013.01); *F01D 25/24* (2013.01); *F04D 29/164* (2013.01); *F04D 29/526* (2013.01)

(58) Field of Classification Search
CPC ..... F01D 11/122; F01D 25/24; F04D 29/164; F04D 29/526
See application file for complete search history.

(56) References Cited

U.S. PATENT DOCUMENTS 4,534,698 A * 8/1985 Tomich ..... F01D 21/045 415/121.2
5,137,419 A * 8/1992 Waterman ..... F04D 29/685 415/170.1
(Continued)

FOREIGN PATENT DOCUMENTS

CN 1933243 A 3/2007
EP 0 719 908 A1 7/1996
(Continued)

OTHER PUBLICATIONS

Search Report dated Dec. 9, 2013 in corresponding International Application No. PCT/FR2013/042172 filed on Sep. 19, 2013 (10 pages).
(Continued)

*Primary Examiner* — Igor Kershteyn
*Assistant Examiner* — Eric Zamora Alvarez
(74) *Attorney, Agent, or Firm* — Bookoff McAndrews, PLLC

(57) ABSTRACT

The invention relates to an assembly comprising a turbine engine casing and a bladed rotor wheel arranged therein. The casing presents an inside wall having a circumferential strip of abradable material. Facing the tips of the blades, the casing presents upstream the strip of abradable material, and downstream a circumferential groove. The strip of abradable material is defined downstream by the circumferential groove. The downstream end of the circumferential groove is in register with or downstream from the trailing edges of the blades. This arrangement optimizes the use of abradable material in the casings of the turbine engines.

19 Claims, 3 Drawing Sheets

(51) Int. Cl.
*F04D 29/52* (2006.01)
*F04D 29/16* (2006.01)

(56) References Cited

U.S. PATENT DOCUMENTS 5,474,417 A 12/1995 Privett et al.
5,607,284 A * 3/1997 Byrne ..... F01D 11/08 415/173.4
6,227,794 B1 * 5/2001 Wojtyczka ..... F01D 11/122 415/173.4
6,382,905 B1 * 5/2002 Czachor ..... F01D 11/122 415/128
6,536,773 B2 * 3/2003 Datta ..... F01D 11/08 277/350
6,830,428 B2 * 12/2004 Le Biez ..... F01D 5/20 415/173.4
8,177,494 B2 * 5/2012 Ward ..... F01D 11/122 415/173.1
2003/0035715 A1 2/2003 Torrance
2007/0147989 A1 * 6/2007 Collins ..... F01D 11/02 415/173.1
2012/0163967 A1 * 6/2012 Krautheim ..... F01D 11/10 415/208.2
2012/0224949 A1 * 9/2012 Harper ..... F01D 21/045 415/9

FOREIGN PATENT DOCUMENTS

EP 1 286 022 A1 2/2003
EP 1 344 895 A2 9/2003
FR 2 947 016 A1 12/2010
GB 2 361 747 A 10/2001
GB 2361747 A 10/2001
JP H08-35402 A 2/1996
JP 2009-174429 A 8/2009
WO WO 2012/025357 A1 3/2012

OTHER PUBLICATIONS

Notice of Reasons for Rejection and English language translation issued in related Japanese App. No. 2015-533666, dated May 30, 2017 (8 pages).

* cited by examiner

TURBINE ENGINE CASING AND ROTOR WHEEL

This application is the U.S. national phase entry under 35 U.S.C. § 371 of International Application No. PCT/FR2013/052172, filed on Sep. 19, 2013, which claims priority to French Patent Application No. FR 1258959, filed on Sep. 25, 2012, the entireties of each of which are incorporated by reference herein.

The invention relates to an assembly comprising a turbine engine casing and a bladed rotor wheel arranged in the casing.

The casing may house one or more rotor wheels, mounted to rotate inside the casing.

In order to optimize the efficiency of the turbine engine, the blades are generally arranged in such a manner that their tips pass as close as possible to the inside wall of the casing.

This can sometimes lead to the tips of the blades coming into contact with the inside wall of the casing, in particular as a result of thermal expansion of the blades or of the blades lengthening under the effect of centrifugal forces, particularly during the first hours of operation of an aeroengine for an airplane or a helicopter.

In order to avoid such contacts damaging the wall of the casing, and in known manner, the inside surfaces of turbine engine casings are sometimes fitted with strips of abradable material (i.e. material that is put there to be subjected to abrasion), which strips are arranged inside the casing in register with the tips of the blades.

The length of the blades is then determined in such a manner that when the turbine engine is running at full speed the blades come into contact with the strip of abradable material.

Under the effect of this friction, during the initial hours of operation of the turbine engine, the strip of abradable material wears down until it reaches a shape that enables it no longer to come into contact with the blades. The shape that is obtained in this way is the shape that provides minimum clearance between the blade tips and the casing.

Nevertheless, the contacts and friction occurring between the strip of abradable material and the tips of the blades leads to wear, to vibration, or indeed to impacts that are prejudicial to long life and good operation of the turbine engine.

It is therefore necessary to minimize the magnitude of those events.

For this purpose, international application WO 2012/025357 describes a casing containing a rotor wheel in which the tips of the blades are arranged so as to be substantially shorter at their downstream ends than at their upstream ends. That solution makes it possible to guarantee that clearance exists at least between the downstream portions of the blade tips and the casing.

Nevertheless, it requires the surface area of the blades to be reduced and thus reduces the work they do on the fluid, thereby reducing the efficiency of the rotor wheel.

The object of the invention is thus to propose an arrangement for the casing and/or the blades that enables clearance between the blades and the casing to be minimized, that limits as much as possible contacts and friction between the blades and the casing, and that conserves maximum effectiveness for the blades.

This object is achieved by an assembly comprising a turbine engine casing and a bladed rotor wheel arranged inside said casing, the casing presenting an inside wall including a circumferential strip of abradable material, and wherein, in register with the tips of the blades, the casing presents upstream, the strip of abradable material, and downstream a circumferential groove, the strip of abradable material being defined downstream by the circumferential groove, and the downstream end of the circumferential groove being arranged axially in register with or downstream from the trailing edges of the blades.

The above-defined casing and rotor wheel assembly that includes, in register with the tips of the blades, an upstream strip of abradable material and a downstream circumferential groove, presents the following advantages.

The strip of abradable material is placed in register with the tips of the blades, over their upstream portions. Specifically, it is over the upstream portions of the tips of the blades that it is the most useful for clearance between the tips of the blades and the casing to be reduced.

Consequently, it is at the upstream portions of the tips of the blades that the use of a strip of abradable material is the most justified. In this region, the strip makes it possible to obtain minimum clearance between the tips of the blades and the casing.

Conversely, at the downstream portions of the tips of the blades, the existence of clearance between the tips of the blades and the casing is of smaller importance. Advantageously, in accordance with the invention, preference is given in this region to avoiding collisions between the tips of the blades and the casing.

For this purpose, in the invention, the casing has a groove that is arranged immediately downstream from the strip of abradable material. The bottom of the groove is thus hollow compared with the strip of abradable material. In other words, the groove presents a radius that is greater than the radius of the strip of abradable material (and more precisely than its inside surface).

This difference in radius means that blades presenting a radius that is substantially constant from their leading edges to their trailing edges can have tips with upstream portions that are very close to the strip of abradable material so that they act in a known manner to wear down the strip while the turbine engine is in use, and downstream portions that come into contact little or not at all with the surfaces of the groove and thus of the casing.

For optimized aerodynamic efficiency of the rotor wheel, the downstream end of the circumferential groove may be situated in register or substantially in register with the downstream ends of the blade tips.

In a variant, in order to avoid any impact between the blades and the casing, it is also possible to provide for the downstream end of the circumferential groove to be arranged axially downstream from the trailing edges of the blades.

The downstream end of the circumferential groove is then preferably located at an axial distance from the trailing edges of the blades that lies in the range 5% to 20% of the axial chord of the blades as measured at the tips of the blades. This distance enables the circumferential groove to present the tips of the blades with sufficient range for movement relative to their nominal position.

By means of the invention, the casing presents an optimized contact surface and advantageously includes a strip of abradable material with minimum axial extent, thereby making it possible to minimize contact and friction between the blades and the casing.

The following various improvements may advantageously be provided singly or in combination:

- the groove, apart from a groove surface formed by the strip of abradable material, may present an axial section that is concave;

a bottom of the groove may comprise a cylindrical portion;

the groove, apart from the groove surface formed by the strip of abradable material, may present an axial section that is concave at all points from upstream to downstream;

the groove may be connected on its downstream side to the inside wall of the casing by a concave connection fillet, in particular having a circularly arcuate section;

the groove may be connected on its downstream side to the inside wall of the casing by a surface that is substantially frustoconical;

a bottom of the groove may present a radius that is less than the maximum radius of the strip of abradable material;

a groove surface may be formed by the strip of abradable material may be frustoconical, the angle of the truncated cone being at least 45°, and preferably at least 60°. By extension, this surface of the groove formed by the strip of abradable material may be formed in a plane extending transversely relative to the casing, and may be perpendicular to the axis of the casing;

the groove may be leakproof, or may present a leakproof bottom. In other words, the groove is not connected to ducts for passing a flow of gas or fluid. It does not allow gas to be extracted or delivered, but serves solely to allow the tips of the blades to rotate freely by avoiding any impacts between them and the casing; and the strip of abradable material covers 30% to 70% of the axial extent of the blades.

The invention also provides an axial flow compressor for a turbine engine including a casing or the assembly (casing plus rotor wheel) as defined above.

Finally, the invention provides a turbine engine having at least one casing as defined above.

The invention can be well understood and its advantages appear better on reading the following detailed description of embodiments given as non-limiting examples. The description refers to the accompanying drawings, in which.

Figure 1:
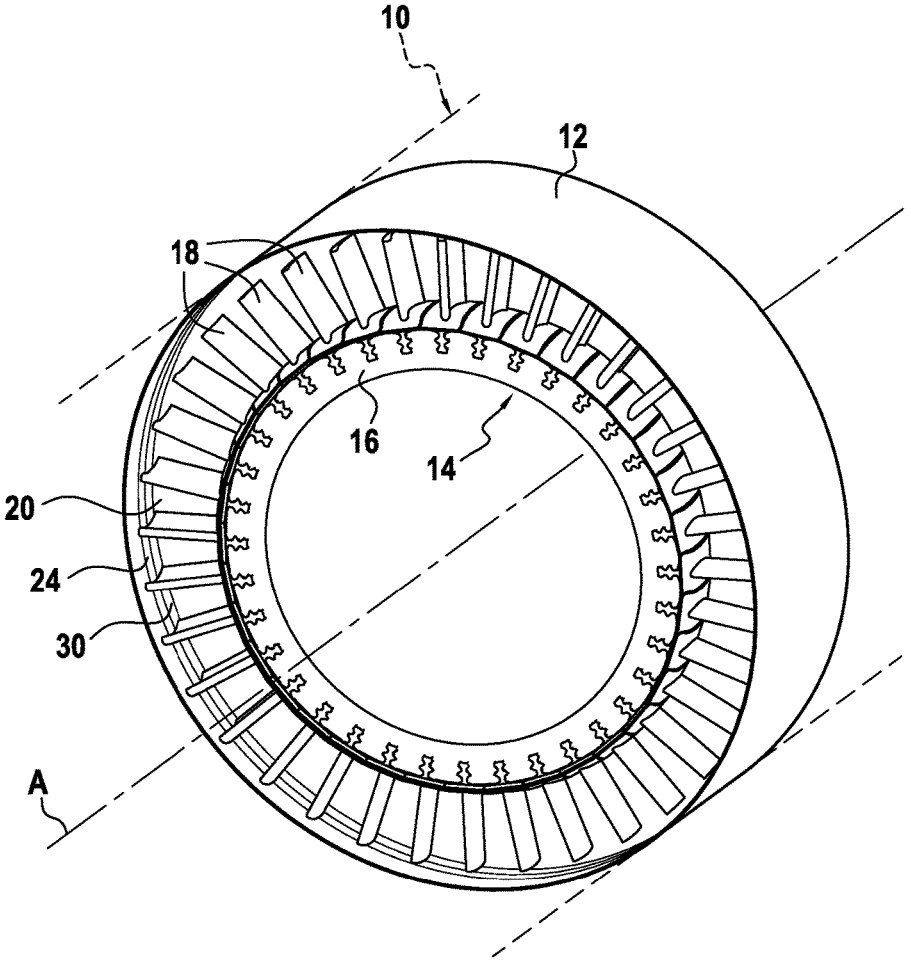
FIG. 1 is a diagrammatic view of a portion of a compressor including a casing of the invention.

FIG. 1 shows an axial flow compressor 10 for a turbine engine. It comprises a casing 12 having a rotor wheel 14 mounted therein. In conventional manner, the rotor wheel 14 itself comprises a rotor disk 16 having radial blades 18 fastened thereto in axisymmetric manner. The rotor wheel is arranged so as to be capable of rotating about an axis of rotation A inside the casing 12.

The casing 12 presents an inside wall 20 defining a gas flow passage. This inside wall forms a surface of revolution that is generally substantially conical in shape, and in the present example that is cylindrical where it is axially in register with the rotor wheel 14.

The arrangement of the blades 18 and of the inside wall 20 of the casing 12 of the invention, is shown for various embodiments in FIGS. 2 to 7.

In the various figures, elements that are identical or similar are given the same numerical references. In addition, the various casings shown respectively in FIGS. 3 to 7 are identical to that shown in FIG. 2, with the exception of the differences mentioned in the text.

In each of FIGS. 2 to 7, the upstream end of the casing 12 (relative to the intended flow direction of gas through the casing) is on the left-hand side of the figure.

Each of the blades 18 has a leading edge 18A, a trailing edge 18B, and a tip 19.

Axially in register with the rotor wheel 14, the radially inner portion of the casing 12 is constituted mainly by two parts: a substantially cylindrical sleeve 22 made of metal or metal alloy (titanium, aluminum, steel, etc. . . . alloy) and a strip 24 of abradable material, that is different from the material of the sleeve 22, e.g. that is made of an Al—Si based alloy.

Upstream and downstream from the blades 18, the sleeve 22 presents a radially inside surface 23 that is substantially cylindrical. The radius R of this surface is slightly greater than the maximum radius of the rotor wheel 14, measured at the tips of the blades 18. The sleeve 22 has no internal channel or passage for conveying a flow of gas past the rotor wheel 14.

In register with or facing the ends of the blades 18, the sleeve 22 includes a housing 26. This housing is in the form of a circular circumferential groove presenting a surface of revolution around the axis A, being hollowed out in the sleeve 22. This housing 26 presents a bottom surface 27 that is generally substantially cylindrical in shape.

The strip 24, which is likewise in the form of a sleeve, is arranged in the housing 26 and occupies its upstream portion.

Consequently, facing the tips of the blades 18, the casing presents upstream the strip 24 of abradable material, and downstream a circumferential groove 30, which is merely the downstream portion of the housing 26.

Figure 2:
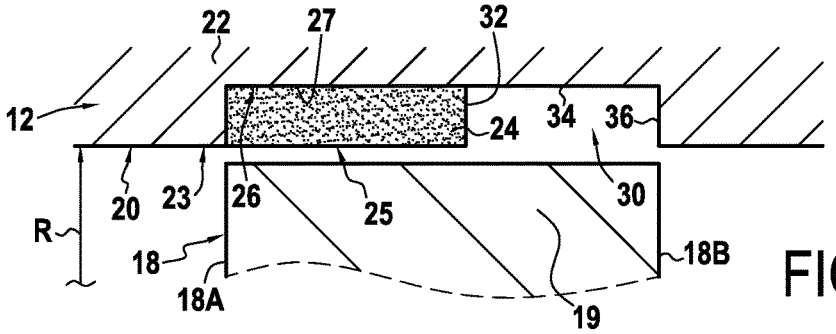
FIG. 2 is a diagrammatic axial section of a portion of a compressor and containing a blade, in a first embodiment of the invention.

The strip 24 presents a radially inside surface 25. The thickness (in a radial direction) of the sleeve 24 is determined in such a manner that when the sleeve 24 is arranged in the housing 26, the inside surface 23 of the sleeve 22 and the inside surface 25 of the strip 24 are continuous one to the other, presenting the same radius R (FIG. 2). The difference in radius between the surface 23 (inside of the sleeve 22) and the surface of the bottom 27 of the housing 26, at the level of the strip 24 is thus equal to the thickness of the strip 24.

The upstream end of the surface 25 of the strip 24 is arranged axially substantially in register with the leading edges 18A of the blades 18, or possibly a little upstream therefrom.

It should be observed that in the context of the invention, the surface 25 of the strip 24 may present a discontinuity (of position and/or of tangent) relative to the surface 23. For example, the strip 24 may present an inside radius that is slightly less than or slightly greater than the radius R of the surface 23 of the sleeve 22.

The downstream end of the strip 24 is situated about halfway along the axis A between the leading edge 18A and the trailing edge 18B of the blade 18. In general, it is preferable for the strip 24 made of abradable material to cover at least 30% of the axial extent of the blades. Furthermore, there is little point in occupying more than 70% of the axial extent of the blades.

Immediately downstream from the strip 24 there is the groove 30. The groove is defined upstream by the strip 24, and at its bottom and on its downstream side by the sleeve 22.

In general terms, from upstream to downstream, the groove 30 presents three successive portions: an upstream portion 32 defined by the strip 24, a bottom 34, and a downstream portion 36.

The upstream portion is formed by the downstream surface of the strip 24. Conversely, the bottom 34 and the downstream portion 36 are not made of abradable material.

They are formed directly in the sleeve 22.

In the embodiments of FIGS. 2 to 6, this surface is arranged in a plane that is transverse relative to the axis A of the casing 12. Consequently, the upstream surface 32 forms an "outward" step at the upstream end of the groove 30 where the diameter of the passage for fluid increases suddenly.

The bottom surface 34 is a portion of the bottom surface of the housing 26. In the embodiments of FIGS. 2 to 4 and 7, the housing 26 presents a bottom surface that is cylindrical, and consequently in these embodiments, the bottom surfaces 27 are cylindrical.

Finally, like the surface 32, the downstream surface 36 of the groove 30 may be arranged in a plane that is transverse to the axis A of the casing 12 (embodiment shown in FIG. 2). As a result, the downstream surface 36 of the groove 30 forms an "inward" step at the downstream end of the groove 30, where the diameter of the fluid flow passage decreases suddenly in order once more to be equal to the diameter of the inside surface of the part 22.

The downstream end of the surface 36 of the groove 30 is arranged axially substantially in register with the trailing edges 18B of the blades 18, or indeed a little downstream therefrom.

The groove 30 thus presents an axial section that is concave.

FIGS. 3 to 7 show various embodiments of the groove 30.

Figure 3:
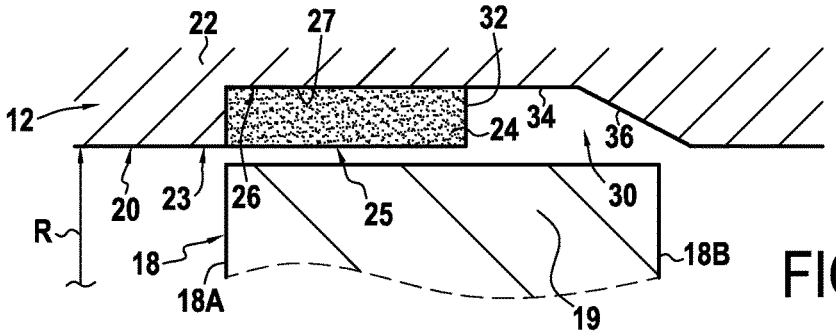
FIG. 3 is a section analogous to that of FIG. 2, showing a second embodiment of the invention.
Figure 4:
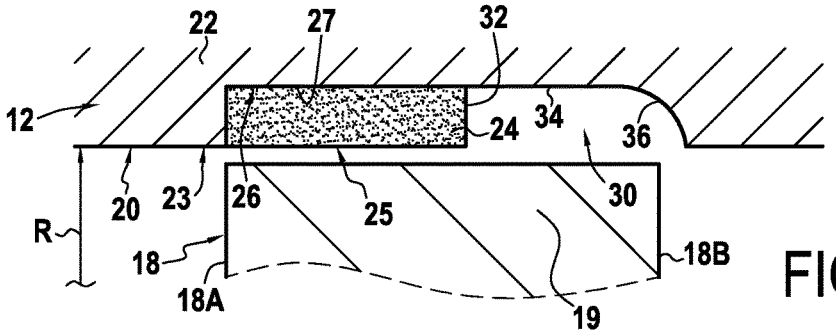
FIG. 4 is a section analogous to that of FIG. 2, presenting a third embodiment of the invention.

The embodiments of FIGS. 3 and 4 differ from the embodiment of FIG. 2 by the arrangement of the downstream surface 36 of the groove 30:

- In FIG. 3, the downstream surface 36 is frustoconical in shape about the axis A. The groove 30 is thus connected at its downstream end to the inside wall 20 of the casing via a substantially frustoconical surface, forming a constant slope in axial section connecting the bottom 34 to the wall 20 of the casing. This shape advantageously limits the formation of turbulence at the downstream ends of the tips of the blades 18.
- In FIG. 4, the downstream surface 36 is a concave connecting fillet having a section in the form of a circular arc. The upstream end of this connection fillet is continuous in position and in tangent with the bottom 34 of the groove 30.

In addition, in these two embodiments, the axial extent of the bottom surface 34 is smaller than in the first embodiment, and conversely the axial extent of the downstream surface 36 is greater. In these embodiments, the surface 34 terminates upstream from the trailing edges of the blades 18 and not in register therewith. The downstream surface 36 of the groove 30 thus extends from the downstream end of the bottom surface 34 upstream from the trailing edges of the blades 18 axially as far as the trailing edges or downstream therefrom.

Figure 6:
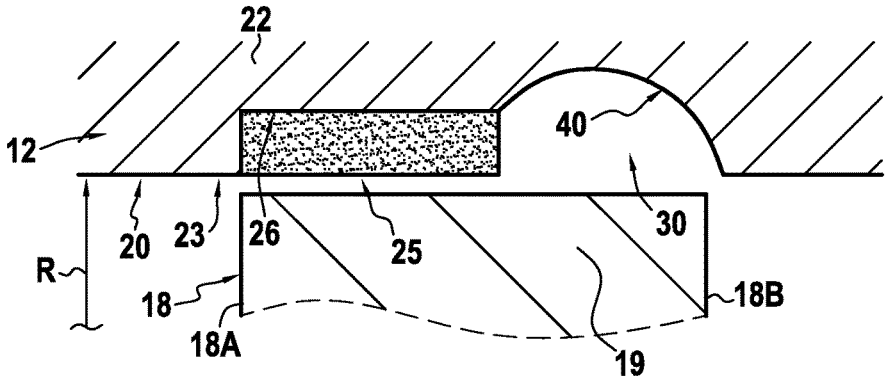
FIG. 6 is a section analogous to that of FIG. 2, showing a fifth embodiment of the invention.

Furthermore, in the embodiments of FIGS. 3, 4, and 6, the downstream end of the circumferential groove is located not in register with the trailing edges 18B of the blades, but downstream therefrom.

In these various embodiments, the downstream end of the circumferential groove is thus located at an axial distance along the axis A and measured from the trailing edges 18B of the blades that lies in the range 5% to 20% of the axial chord of the blades as measured at the blade tips. The value of the "axial chord" of the blades corresponds to the distance along the axis A as shown in the figures between the leading edges 18A and the trailing edges 18B of the blades.

Figure 5:
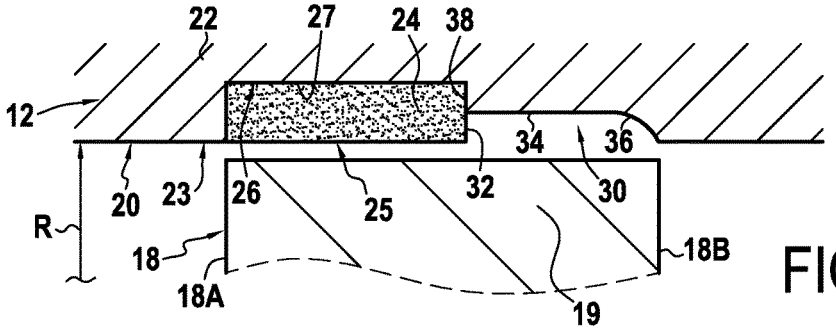
FIG. 5 is a section analogous to that of FIG. 2, showing a fourth embodiment of the invention.

The embodiment of FIG. 5 is similar to that of FIG. 4. The only difference lies in the shape of the bottom of the housing 26.

Unlike the embodiments of FIGS. 2 to 4, in the embodiment of FIG. 5, the bottom of the housing 26 is subdivided into two portions: an upstream portion that receives the strip 24 and a downstream portion that forms the groove 30. Both of these two portions are cylindrical in shape; the upstream portion has an inside diameter that is greater than the downstream portion, and consequently these two portions are separated by a shoulder 38.

The shoulder 38 serves to hold the strip 34 in position, in particular in the axial direction.

FIG. 6 shows an embodiment in which the bottom surface 24 and the downstream surface 36 are continuous; there is no perceptible boundary between them.

The surfaces 34 and 36 taken together constitute a single surface 40.

This surface 40 presents an axial section that is locally strictly concave at all points from upstream to downstream, and consequently this surface section does not have any straight line segment. Its shape may be arbitrary, and should ideally be determined by experiment or by calculation so as to ensure that, in all operating modes of the turbine engine, the surfaces 34 and 36 (and thus the surface 40) remain without contact with the blades 18.

Figure 7:
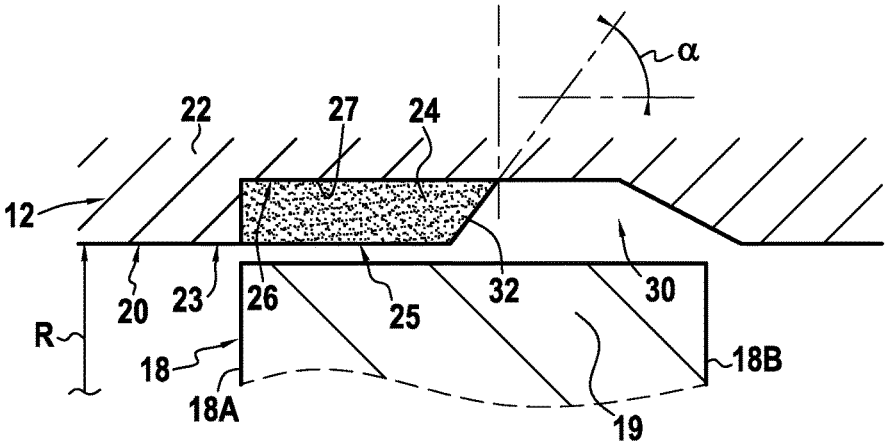
FIG. 7 is a section analogous to that of FIG. 2, showing a sixth embodiment of the invention.

Finally, FIG. 7 shows an embodiment that differs from that shown in FIG. 3 in the shape of the upstream surface 32 of the groove 30.

Instead of this upstream surface being perpendicular to the axis A of the casing, the upstream surface 32 is frustoconical about the axis A. Relative to this axis it forms an angle at the apex that is equal to 45°.

In order to avoid pointlessly overdimensioning the strip of abradable material 24, the angle is preferably not less than 45°.

In the various embodiments described, the tips 19 of the blades 18 are situated radially strictly inside the wall 20. In addition, the length of the blades (measured in the radial direction) is constant.

Neither of those two characteristics is essential for the invention.

In the context of the invention, the blades may have a length (measured in the radial direction) that varies as a function of position along the axis of the rotor wheel. The blades may thus present a total radius (overall radius for the blades when mounted on the rotor wheel) that varies in the axial direction.

In the context of the invention, the blades may also present a total radius that might possibly be greater than the radius of the inside surface of the casing immediately upstream or downstream from the rotor wheel, or that is at least locally greater than that radius (i.e. over only a certain axial range along the axis of the rotor wheel). The tips of the blades then penetrate at least locally into the wall of the casing.

The blades may also present non-uniform radial clearance relative to the casing, as shown in particular in the above-described embodiment.

Consequently, the total radius of the blades may be less than or greater than the inside radius (R) of the surface of the casing immediately upstream or downstream from the blades. The total radius of the blades may also vary between these two configurations as a function of position along the axis of the rotor wheel.

The invention claimed is:

1. An assembly comprising a turbine engine casing and a bladed rotor wheel arranged inside the casing, the casing presenting an inside wall including a circumferential strip of abradable material, wherein, in register with tips of blades and facing the tips of the blades, the casing presents upstream, the strip of abradable material, and downstream a circumferential groove, wherein the circumferential groove is located entirely downstream of the strip of abradable material, the strip of abradable material being defined downstream by the circumferential groove, and the downstream end of the circumferential groove being arranged axially in register with or downstream from trailing edges of the blades, wherein the groove is leakproof, is not connected to any duct for passing a flow of fluid through the groove, and allows the tips of the blades to rotate freely while avoiding any impact between the blades and the casing, and wherein a direct circumferential path from a tip of a given blade to a tip of an adjacent blade is free of material.

2. The assembly according to claim 1, wherein the circumferential groove, apart from a circumferential groove surface formed by the strip of abradable material, presents an axial section that is concave; and wherein the circumferential groove, apart from the circumferential groove surface formed by the strip of abradable material, presents an axial section that is concave at all points from upstream to downstream.

3. The assembly according to claim 1, wherein a bottom of the circumferential groove comprises a cylindrical portion.

4. The assembly according to claim 1, wherein the circumferential groove is connected on its downstream side to the inside wall of the casing by a concave connection fillet.

5. The assembly according to claim 1, wherein the circumferential groove is connected on its downstream side to the inside wall of the casing by a surface that is substantially frustoconical.

6. The assembly according to claim 1, wherein a bottom of the circumferential groove presents a radius that is less than a maximum radius of the strip of abradable material.

7. The assembly according to claim 1, wherein a circumferential groove surface formed by the strip of abradable material is frustoconical, an angle of a truncated cone being at least 45°.

8. The assembly according to claim 1, wherein the strip of abradable material covers 30% to 70% of an axial extent of said blades.

9. A turbine engine, including at least one assembly according to claim 1.

10. The assembly according to claim 1, wherein the circumferential groove is connected on its downstream side to the inside wall of the casing by a concave connection fillet having a circularly arcuate section.

11. The assembly according to claim 1, wherein a circumferential groove surface formed by the strip of abradable material is frustoconical, an angle of the truncated cone being at least 60°.

12. The assembly according to claim 1, wherein the circumferential groove is positioned radially outside the tips of the blades.

13. The assembly according to claim 1, wherein a bottom of the circumferential groove presents a radius that is equal to or less than a maximum radius of the strip of abradable material.

14. An assembly comprising a turbine engine casing and a bladed rotor wheel having a plurality of blades arranged inside the casing, the casing presenting an inside wall including a circumferential strip of abradable material, wherein, in register with tips of the plurality of blades and facing the tips of the plurality of blades, the casing presents upstream, the strip of abradable material, and downstream a circumferential groove, wherein the circumferential groove is located entirely downstream of the strip of abradable material, the strip of abradable material being defined downstream by the circumferential groove, and the downstream end of the circumferential groove being arranged axially in register with or downstream from trailing edges of the plurality of blades, wherein a bottom of the circumferential groove presents a radius that is equal to or less than the maximum radius of the strip of abradable material.

15. The assembly according to claim 14, wherein the circumferential groove is leakproof, is not connected to any duct for passing a flow of fluid through the circumferential groove, and allows the tips of the plurality of blades to rotate freely while avoiding any impact between the plurality of blades and the casing.

16. The assembly according to claim 14, wherein each of the plurality of blades includes a longest dimension in a radial direction.

17. The assembly according to claim 14, wherein the circumferential groove is connected on its downstream side to the inside wall of the casing by a concave connection fillet having a circularly arcuate section.

18. The assembly according to claim 14, wherein the circumferential groove is axially in register with or downstream from downstream-most portions of the plurality of blades.

19. An assembly comprising a turbine engine casing and a bladed rotor wheel having a plurality of blades arranged inside the casing, the casing presenting an inside wall including a circumferential strip of abradable material, wherein the circumferential strip of abradable material (i) is in register with tips of the plurality of blades and (ii) includes a surface of the circumferential strip of abradable material facing the tips of the plurality of blades, the casing further including a circumferential groove defined in the inside wall and positioned entirely downstream of the circumferential strip of abradable material, wherein the circumferential groove defines a surface facing the tips of the plurality of blades, wherein a portion of the surface of the circumferential groove facing the tips of the plurality of blades is positioned farther from the tips of the plurality of blades than the surface of the circumferential strip of abradable material that faces the tips of the plurality of blades, and wherein a downstream portion of the circumferential groove is arranged axially in register with or downstream from trailing edges of the plurality of blades.

* * * * *